US006158469A

United States Patent [19]

Yen

[11] Patent Number: 6,158,469

[45] Date of Patent: Dec. 12, 2000

[54] SPOUT ASSEMBLY ADAPTED TO BE IN FLUID COMMUNICATION WITH A FAUCET

[75] Inventor: David Yen, Taichung, Taiwan

[73] Assignee: Globe Union Industrial Corporation, Taiwan

[21] Appl. No.: 09/404,632

[22] Filed: Sep. 23, 1999

[51] Int. Cl.[7] ..... E03C 1/02

[52] U.S. Cl. ..... 137/801; 4/678; 239/587.1

[58] Field of Search ..... 4/678; 137/801; 239/587.1; 285/302

[56] References Cited

U.S. PATENT DOCUMENTS

| | | | |
|---|---|---|---|
| 1,758,115 | 5/1930 | Kelly | 239/587.1 X |
| 2,100,186 | 11/1937 | Hagopian | 239/587.1 X |
| 2,776,168 | 1/1957 | Schweda | 239/587.1 X |

*Primary Examiner*—Gerald A. Michalsky

*Attorney, Agent, or Firm*—Foley & Lardner

[57] ABSTRACT

A spout assembly includes an inner tube adapted to be in fluid communication and in watertight connection with a faucet body, and an outer tube telescopically fitted on the inner tube. An outer circumferential wall of the inner tube has a plurality of annular retaining grooves disposed therein and spaced apart from and aligned with one another for receiving annular elastomeric members. Each elastomeric member extends beyond the outer circumferential wall to form an annular bump portion. The outer tube is slidably fitted on the outer circumferential wall, and has an inner peripheral wall with an annular friction member to surround and in slidable contact with the outer circumferential wall. Thus, when the friction member is brought into engagement with one of the annular bump portions by sliding movement of the inner peripheral wall, the engaged annular bump portion will be deformed radially to increase the friction force therebetween so as to arrest the inner peripheral wall from moving relative to the outer circumferential wall.

5 Claims, 4 Drawing Sheets

SPOUT ASSEMBLY ADAPTED TO BE IN FLUID COMMUNICATION WITH A FAUCET

BACKGROUND OF THE INVENTION

1. Field of the Invention

This invention relates to a spout assembly adapted to be in fluid communication with a faucet, more particularly to a spout assembly with telescopic inner and outer tubes and a lock member to retain the outer tube relative to the inner tube.

2. Description of the Related Art

Referring to FIG. 1, a conventional faucet is shown to be mounted on a kitchen sink 4 and includes a faucet body 1, a valve 2 to control the flow of water stream into the faucet body 1, and a spout 3 mounted on and movable relative to the faucet body 1 toward dish accommodating spaces 4*a,* 4*b.* Since the length of the spout 3 is fixed, it is difficult for the flow of water stream from the spout 3 to reach the surrounding wall of the larger dish accommodating space 4*a,* thereby causing inconvenience to the user.

SUMMARY OF THE INVENTION

The object of the present invention is to provide a spout assembly which has telescopic outer and inner tubes adapted to be mounted on and in fluid communication with a faucet body and a lock member to retain the outer tube relative to the inner tube.

According to this invention, the spout assembly includes an inner tube and an outer tube telescopically fitted on the inner tube. The inner tube includes a first tubular end portion adapted to be in fluid communication and in water tight connection with a faucet body, a second tubular end portion opposite to the first tubular end portion in an axial direction, and an intermediate tubular portion interposed therebetween. The intermediate tubular portion has an outer circumferential wall with a plurality of annular retaining grooves disposed therein, and spaced apart from and aligned with one another in the axial direction. The outer tube includes a proximate tubular end slidably fitted on the outer circumferential wall and proximate to the first tubular end portion, a distal tubular end opposite to the proximate tubular end and extending beyond the second tubular end portion, and a middle tubular portion interposed therebetween, and having an inner peripheral wall. The inner peripheral wall faces the outer circumferential wall and includes first and second segments respectively proximate and distal to the proximate tubular end. An annular friction member is disposed in the first segment to surround and in slidable contact with the outer circumferential wall so as to retard sliding movement of the first segment relative to the outer circumferential wall. A plurality of annular elastomeric members are sleeved on and are received in the annular retaining grooves, respectively. Each annular elastomeric member radially extends beyond the outer circumferential wall to form an annular bump portion. Thus, when the friction member is brought into engagement with one of the annular bump portions by the sliding movement of the inner peripheral wall in the axial direction, the engaged annular bump portion will be deformed radially, thereby increasing the friction force therebetween so as to arrest the inner peripheral wall from moving relative to the outer circumferential wall.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
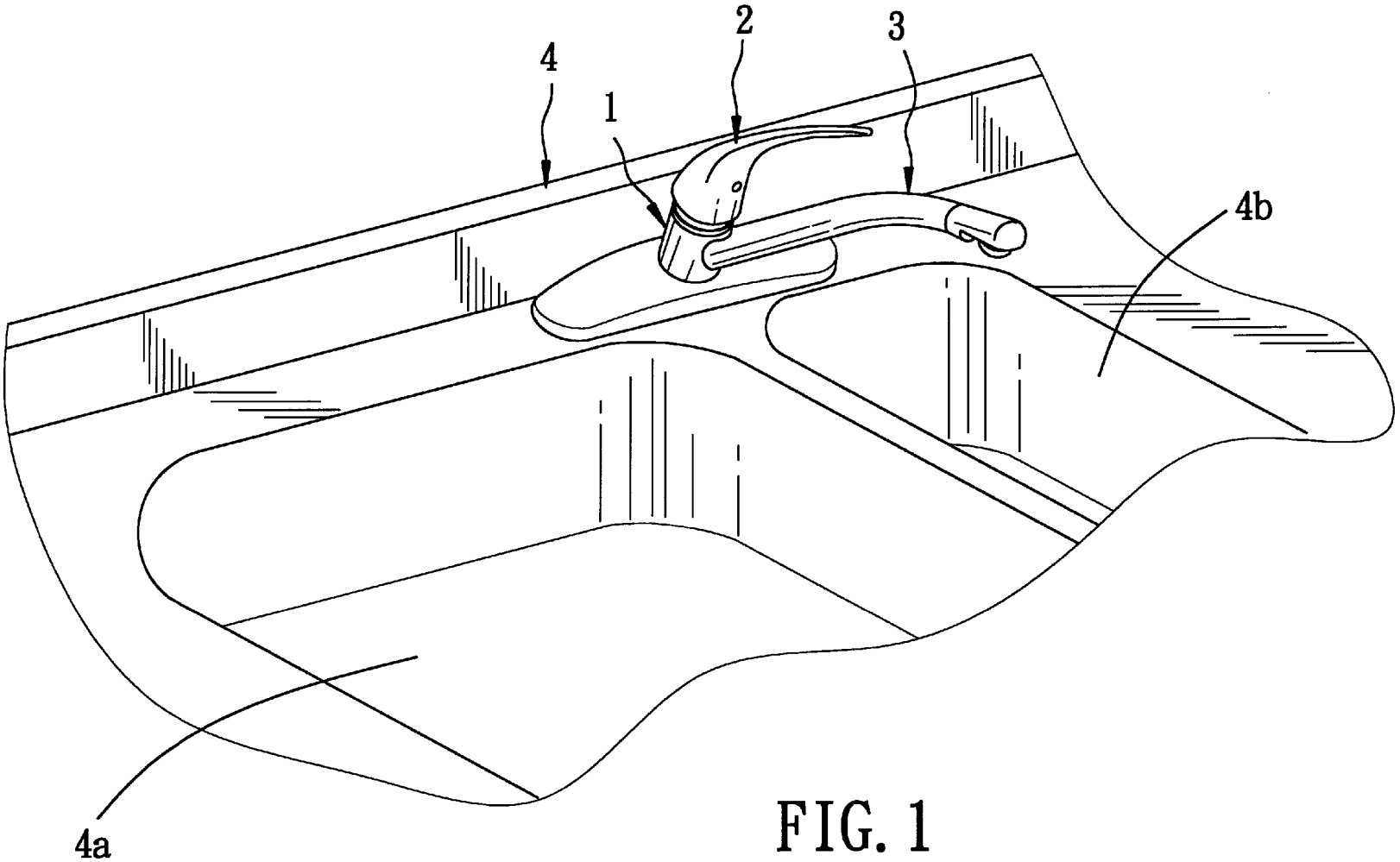
FIG. 1 PRIOR ART
FIG. 1 is a schematic perspective view of a conventional faucet on a kitchen sink.
Figure 2:
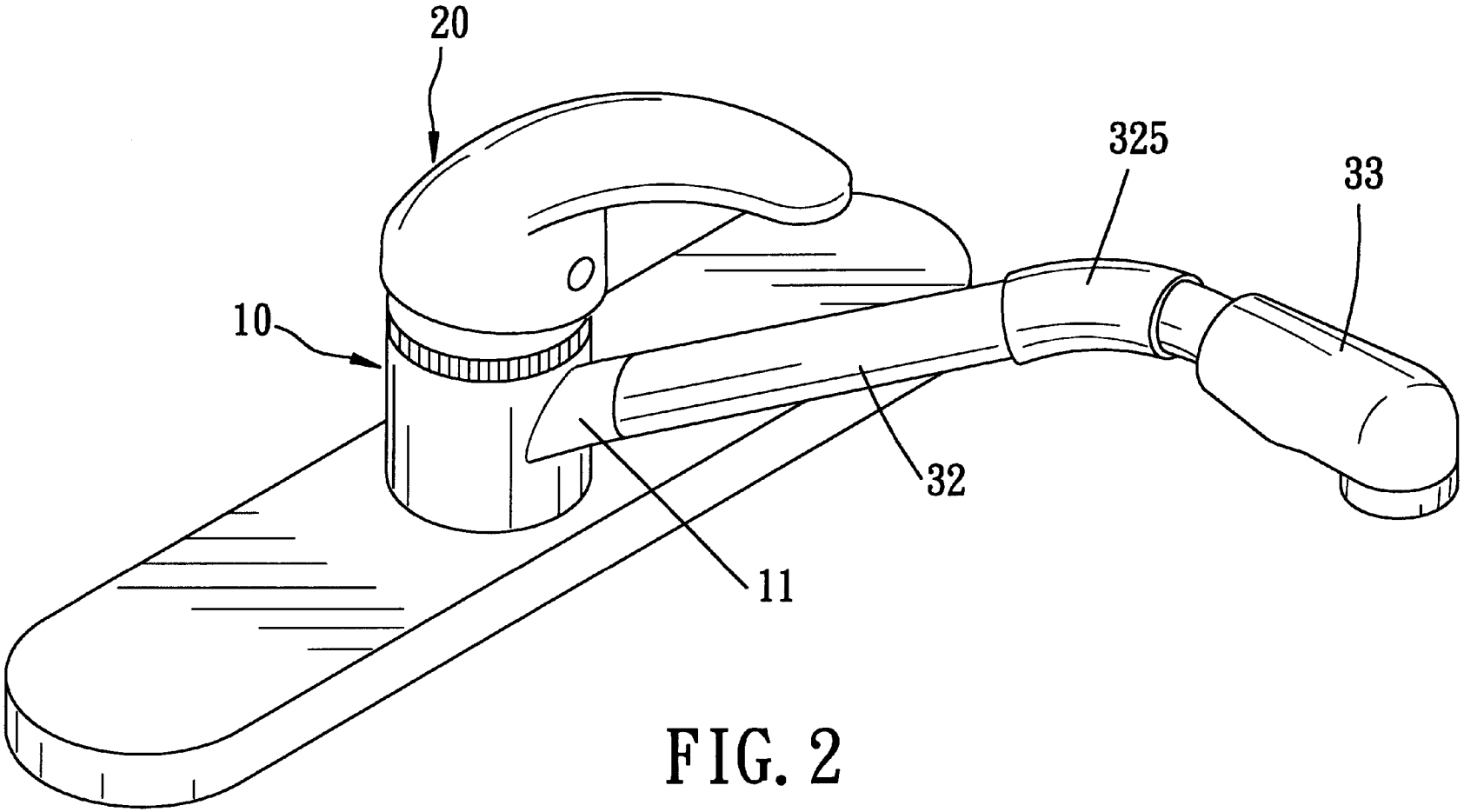
FIG. 2 is a perspective view of a preferred embodiment of a spout assembly according to this invention when mounted on a faucet body.
Figure 3:
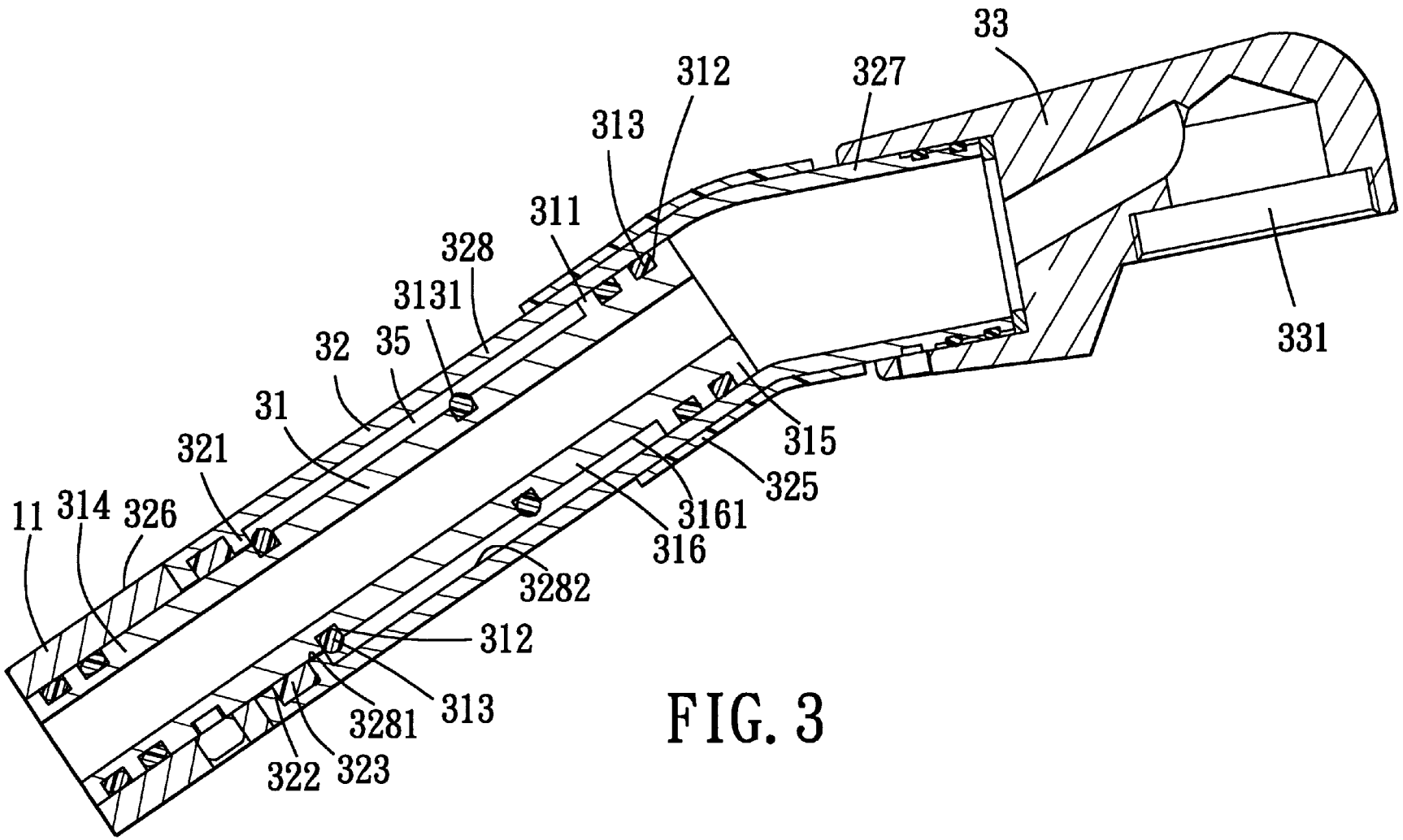
FIG. 3 is a sectional view of the preferred embodiment.

Referring to FIG. 2, the preferred embodiment of the spout assembly according to the present invention is shown to be mounted on and in fluid communication with a faucet body 10 of a faucet. The faucet has a valve 20 to control the flow of water stream into the faucet body 10. With reference to FIG. 3, the spout assembly includes an inner tube 31 and an outer tube 32 which is telescopically fitted on the inner tube 31.

The inner tube 31 includes a first tubular end portion 314 which is adapted to be in fluid communication and in water tight connection with an outlet tube 11 of the faucet body 10, a second tubular end portion 315 opposite to the first tubular end portion 314 in an axial direction, and an intermediate tubular portion 316 which is interposed between the first and second tubular end portions 314,315, and which has an outer circumferential wall 3161. The outer circumferential wall 3161 has a plurality of annular retaining grooves 312 which are disposed therein and which are spaced apart from and aligned with one another in the axial direction. In addition, the second tubular end portion 315 has two annular grooves 312 for receiving two friction rings 313 therein for water tight contact with the outer tube 32.

Figure 4:
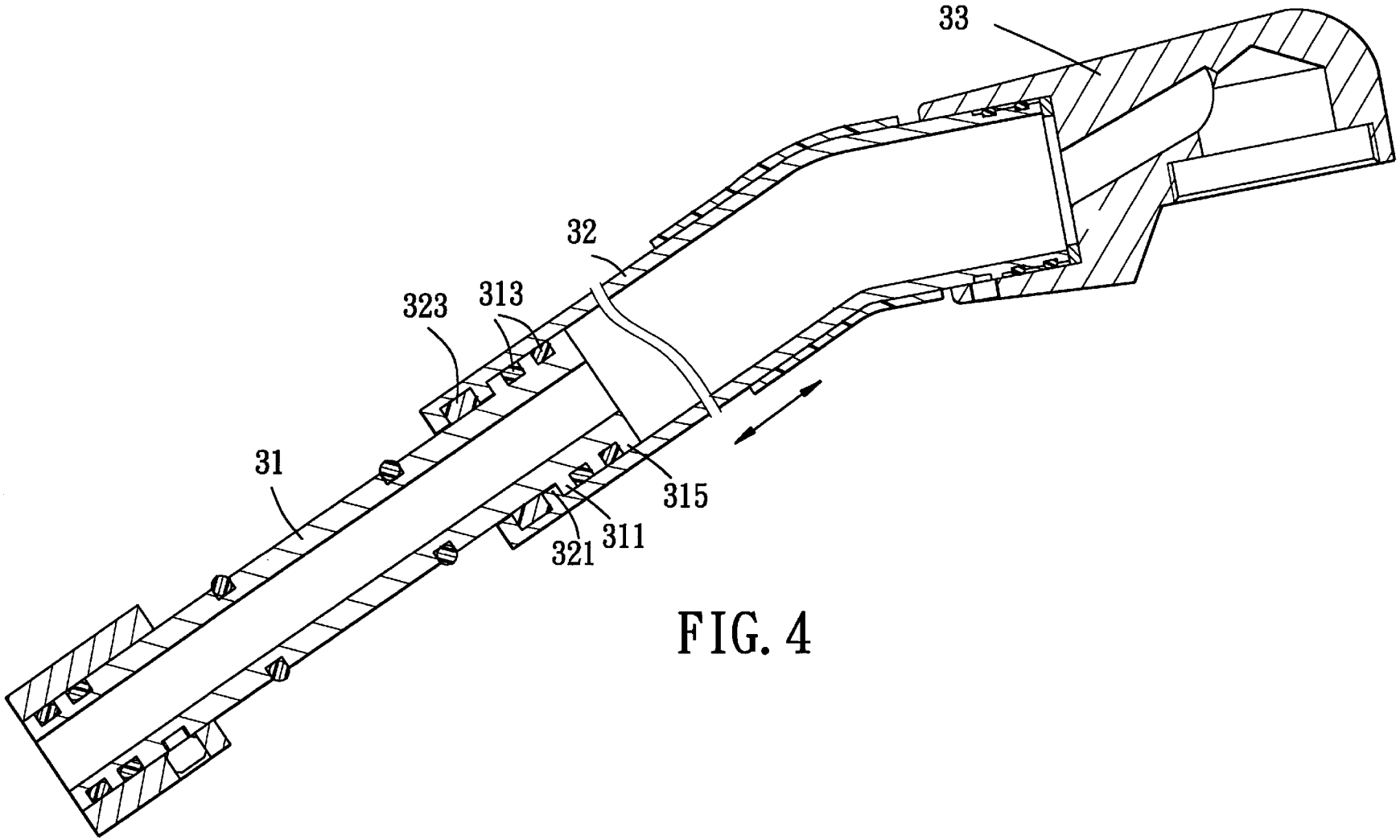
FIG. 4 is a sectional view of the preferred embodiment in an extended state.

The outer tube 32 includes a proximate tubular end 326 which is slidably fitted on the outer circumferential wall 3161 and proximate to the first tubular end portion 314, a distal tubular end 327 which is disposed opposite to the proximate tubular end 326 and which extends beyond the second tubular end portion 315, and a middle tubular portion 328 which is interposed between the proximate and distal tubular ends 326,327. The middle tubular portion 328 has an inner peripheral wall which faces the outer circumferential wall 3161 and which includes first and second segments 3281,3282 respectively proximate and distal to the proximate tubular end 326. The second segment 3282 is radially spaced from the outer circumferential wall 3161. In particular, the middle tubular portion 328 has an annular abutment shoulder 321 which is disposed radially at a juncture of the first and second segments 3281,3282. The outer circumferential wall 3161 has an annular barrier portion 311 which is disposed proximate to the second tubular end portion 315 so as to cooperate with the abutment shoulder 321 to confine an annular accommodating area 35 between the second segment 3282 and the outer circumferential wall 3161. Thus, the abutment shoulder 321 will be blocked by the barrier portion 311 from further movement during the sliding movement of the first segment 3281 relative to the outer circumferential wall 3161 so as to prevent the first segment 3281 from slipping over and falling out of the second tubular end portion 315, as shown in FIG. 4.

An annular friction member 323 is disposed in an annular groove 322 of the first segment 3281 to surround and to be in slidable contact with the outer circumferential wall 3161 of the inner tube 31 so as to retard sliding movement of the first segment 3281 relative to the outer circumferential wall 3161.

A plurality of annular elastomeric members 313 are sleeved on and are received in the annular retaining grooves 312, respectively. Each elastomeric member 313 is of a dimension to radially extend beyond the outer circumferential wall 3161 to form an annular bump portion 3131. As such, when the friction member 323 is brought into engagement with one of the annular bump portions 3131 by sliding movement of the inner peripheral wall of the outer tube 32 in the axial direction, the engaged annular bump portion 3131 will be deformed radially, thereby increasing the friction force therebetween so as to arrest the inner peripheral wall from moving relative to the outer circumferential wall 3161.

A spout head 33 is mounted on the distal tubular end 327 of the outer tube 32, and has an outlet 331 for changing directions of the water stream.

As illustrated, with the telescopic construction of the inner and outer tubes 31,32, the distance between the spout head 33 and the outlet tube 11 can be increased. In addition, with the friction engagement between the annular bump portions 3131 and the friction member 323, the inner peripheral wall of the outer tube 32 is arrested from moving relative to the outer circumferential wall 3161 of the inner tube 31.

In addition, a scald-preventing member 325 can be disposed to wrap around the middle tubular portion 328 proximate to the distal tubular end 327 to serve as a handgrip.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A spout assembly adapted to be in fluid communication with a faucet body of a faucet which includes a valve to control the flow of water stream into the faucet body, said spout assembly comprising:

an inner tube including a first tubular end portion adapted to be in fluid communication and in water tight connection with the faucet body, a second tubular end portion opposite to said first tubular end portion in an axial direction, and an intermediate tubular portion interposed between said first and second tubular end portions and having an outer circumferential wall, wherein said outer circumferential wall has a plurality of annular retaining grooves disposed therein, and spaced apart from and aligned with one another in the axial direction;

an outer tube telescopically fitted on said inner tube, and including a proximate tubular end slidably fitted on said outer circumferential wall and proximate to said first tubular end portion, a distal tubular end opposite to said proximate tubular end and extending beyond said second tubular end portion, a middle tubular portion interposed between said proximate and distal tubular ends, and including an inner peripheral wall that faces said outer circumferential wall and that includes first and second segments respectively proximate and distal to said proximate tubular end, and an annular friction member disposed in said first segment to surround, and in slidable contact with said outer circumferential wall so as to retard sliding movement of said first segment relative to said outer circumferential wall; and a plurality of annular elastomeric members, each sleeved on and received in a respective one of said annular retaining grooves, and of such a dimension to radially extend beyond said outer circumferential wall to form an annular bump portion, whereby when said friction member is brought into engagement with one of said annular bump portions by sliding movement of said inner peripheral wall in the axial direction, said one of said annular bump portions will be deformed radially, thereby increasing the friction force therebetween so as to arrest said inner peripheral wall from moving relative to said outer circumferential wall.

2. The spout assembly as claimed in claim 1, wherein said second segment of said middle tubular portion is radially spaced from said outer circumferential wall to define an annular accommodating area therebetween, said annular retaining grooves being disposed within said annular accommodating area.

3. The spout assembly as claimed in claim 2, wherein said middle tubular portion has an annular abutment shoulder disposed radially at a juncture of said first and second segments, said outer circumferential wall having an annular barrier portion disposed proximate to said second tubular end portion and cooperating with said abutment shoulder to confine said annular accommodating area in the first axial direction such that said abutment shoulder will be blocked by said barrier portion from further movement during the sliding movement of said first segment relative to said outer circumferential wall so as to prevent said first segment from slipping over and falling out of said second tubular end portion.

4. The spout assembly as claimed in claim 1, further comprising a spout head mounted on said distal tubular end for changing directions of the water stream.

5. The spout assembly as claimed in claim 1, further comprising a scald-preventing member disposed to wrap around said middle tubular portion.

* * * * *